United States Patent [19]

Palmer et al.

[11] 4,123,740

[45] Oct. 31, 1978

[54] ADJUSTABLE POTENTIOMETER IN AN ACCELERATOR CONTROL

[75] Inventors: Norman H. G. Palmer, Mentor; Wayne T. Wiblin, Ashtabula, both of Ohio

[73] Assignee: Towmotor Corporation, Mentor, Ohio

[21] Appl. No.: 812,093

[22] Filed: Jul. 1, 1977

[51] Int. Cl.[2] ..... H01C 13/00

[52] U.S. Cl. ..... 338/67; 180/65 R; 338/153; 338/172; 338/198

[58] Field of Search ..... 338/67, 153, 198, 172, 338/200, 215; 74/478, 560, 561, 515; 180/65 R, 77 R; 214/78, 80

[56] References Cited

U.S. PATENT DOCUMENTS

| | | | |
|---|---|---|---|
| 2,192,714 | 3/1940 | Norman et al. | 338/153 X |
| 2,379,774 | 7/1945 | Wyer | 338/153 |
| 3,507,350 | 4/1970 | Boyajian | 180/65 R |
| 3,560,629 | 2/1971 | Tucci | 74/512 X |
| 4,047,145 | 9/1977 | Schwehr | 338/67 |

*Primary Examiner*—C. L. Albritton
*Attorney, Agent, or Firm*—James R. Bell

[57] ABSTRACT

An apparatus having an accelerator element has a potentiometer including an inner portion movable relative to an outer portion thereof in response to movement of the accelerator element. Adjusting and support members are interconnected for adjusting the outer potentiometer portion relative to the inner portion.

15 Claims, 3 Drawing Figures

ADJUSTABLE POTENTIOMETER IN AN ACCELERATOR CONTROL

BACKGROUND OF THE INVENTION

1. Field of the Invention

This invention relates generally to motor vehicles and more particularly to those of the fork lift type which are electrically powered.

2. Description of the Prior Art

Typically, electrically powered lift trucks include a potentiometer in their accelerator control. The potentiometer is connected to permit increased speed upon demand by the vehicle operator.

If the potentiometer is set incorrectly, it will not be possible either to achieve minimum or maximum speed.

The problem relates to setting the potentiometer so that the most desirable maximum and minimum points of voltage in the potentiometer can be coordinated with the at rest and full travel positions of the accelerator control. The problem is similar to setting the proper idle speed for internal combustion engines.

In view of the above, it would be advantageous to provide a means for efficiently adjusting a potentiometer in an accelerator control of an electrically powered vehicle which overcomes the problems associated with the prior art.

SUMMARY OF THE INVENTION

The present invention is directed to overcoming one or more of the problems as set forth above.

According to the present invention this is accomplished by providing an adjustable potentiometer in an accelerator control. Thus, an apparatus having an accelerator element also has a potentiometer including an inner portion movable relative to an outer portion thereof in response to movement of the accelerator element.

An adjusting member is connected for adjusting the outer potentiometer portion relative to the inner portion. A support member is connected for supporting the adjusting member relative to the potentiometer. A positioning member interconnects the adjusting and support members for positioning the adjusting member relative to the support member.

The foregoing and other advantages will become apparent from the following detailed description of the invention when considered in conjunction with the accompanying drawings. It is to be expressly understood, however, that the drawings are not intended as a definition of the invention but are for the purpose of illustration only.

DETAILED DESCRIPTION

Figure 1:
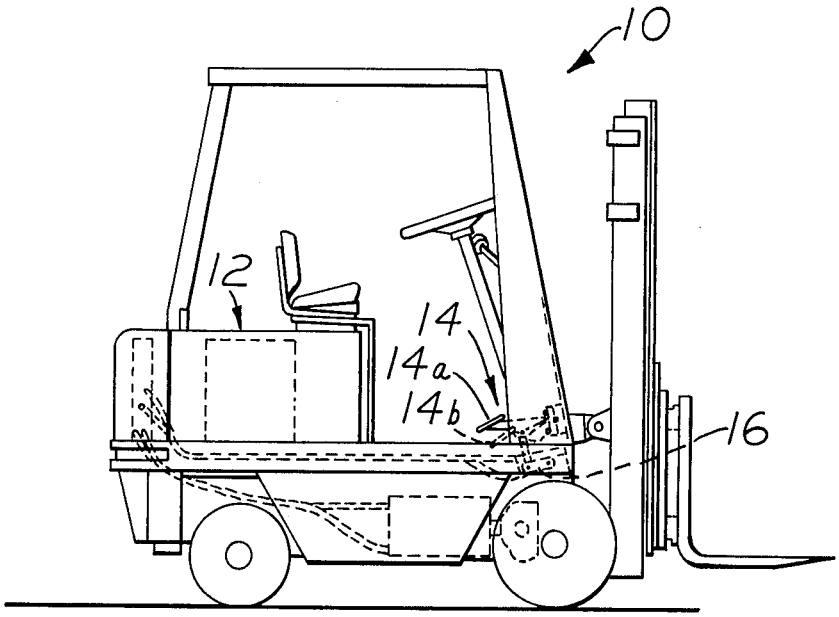
FIG. 1 is a diagrammatic side view illustrating a vehicle having the apparatus of this invention.
Figure 2:
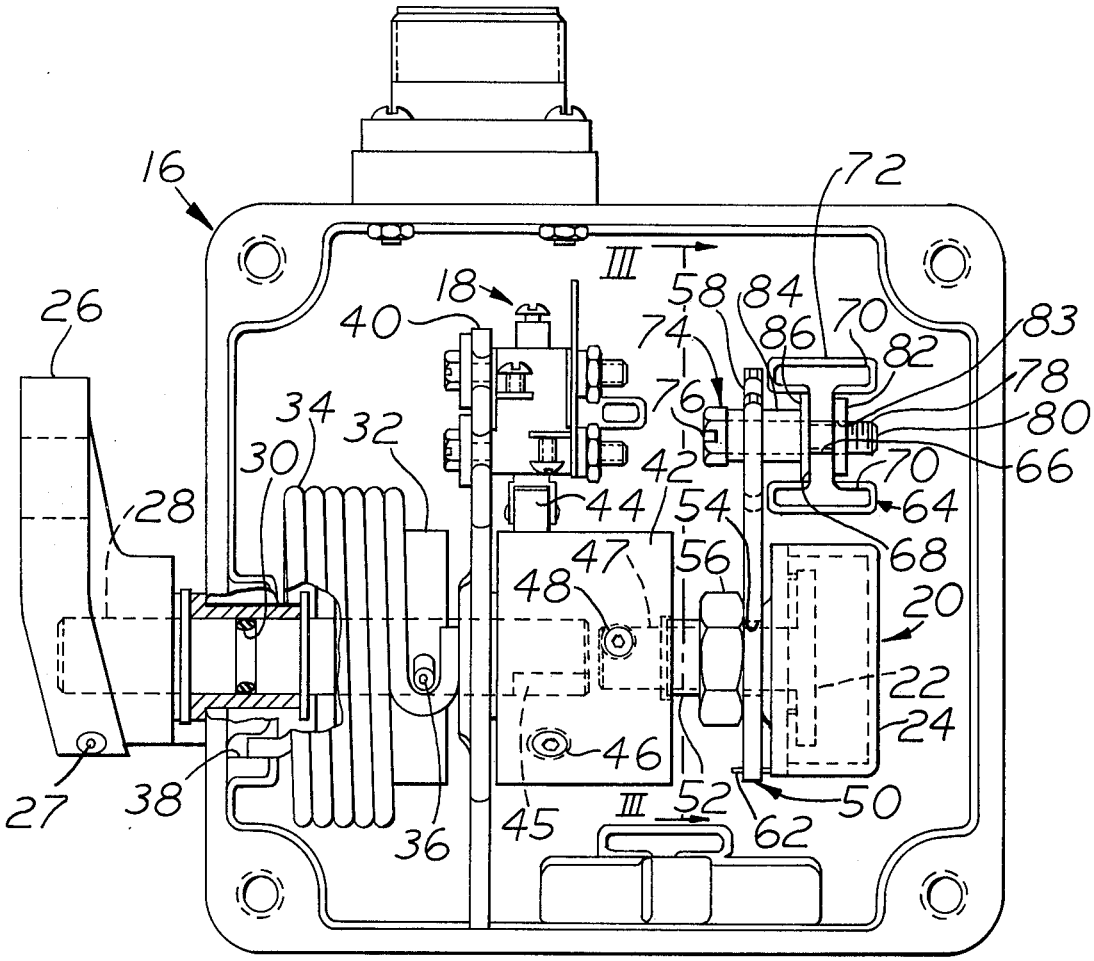
FIG. 2 is a side elevational view illustrating the accelerator control housing having the apparatus of this invention.

Referring to FIGS. 1 and 2, an apparatus, for example an electrically operated lift truck 10, has an electrical power source 12, a movable accelerator element such as foot pedal 14, operably connected to an accelerator control housing 16 preferably of a suitable injection molded plastic. A switch 18 in housing 16 is actuatable in response to movement of accelerator element 14. A potentiometer 20 in housing 16 includes an inner potentiometer portion 22 movable relative to an outer potentiometer portion 24 in response to movement of accelerator element 14. Element or pedal 14 has an "at rest" position 14*a* where no pressure is applied and a "full travel" position 14*b* where the pedal is depressed to its physical limit.

More particularly, accelerator element 14 is operably connected to move accelerator arm 26 mounted on housing 16. A set screw 27 secures arm 26 with a shaft 28 so that shaft 28 will rotate in response to movement of arm 26. Shaft 28 sealingly extends into housing 16 due to a sealing "O" ring 30 on shaft 28.

A spacer 32 is secured to rotate with shaft 28. A torsion spring 34 is engaged with a pin 36 extending from spacer 32 at one spring end, and is engaged with an aperture 38 formed in housing 16 at another spring end thus providing a return spring for returning shaft 28 to an "at rest" position, as is well known.

A rib 40, also preferably of injection molded plastic, mounted in housing 16, supports shaft 28 and on-off switch 18. A cam 42 is secured by set screw 46 urged against a flat portion 45 to rotate with shaft 28 and engages a roller 44 of switch 18 for engaging and disengaging switch 18 in the well known manner.

Inner potentiometer portion 22 is connected to cam 42 via a shaft 47 and set screw 48 urged against a flat portion 49 in the well known manner. Shaft 47 extends through a sleeve 52 which is secured to outer portion 24. In this manner, inner potentiometer portion 22 rotates in response to rotation of shaft 28. Preferably, shafts 28 and 47 are coaxially aligned.

In the past, outer potentiometer portion 24 has been secured to housing 16 in some suitable manner so as to maintain portion 24 stationary. This permitted inner portion 22 to move relative to outer portion 24 by rotating within the outer portion upon rotation of shaft 47. This arrangement is necessary; however, no means are provided for adjusting the potentiometer for maximum efficiency. That is, no effective means are provided to adjust the outer portion 24 relative to the inner portion 22 after potentiometer 20 is mounted in housing 16 so that the most desirable maximum and minimum points of voltage in potentiometer 20 can be coordinated with the at rest and full travel positions 14*a*, 14*b*, respectively, of pedal 14.

Figure 3:
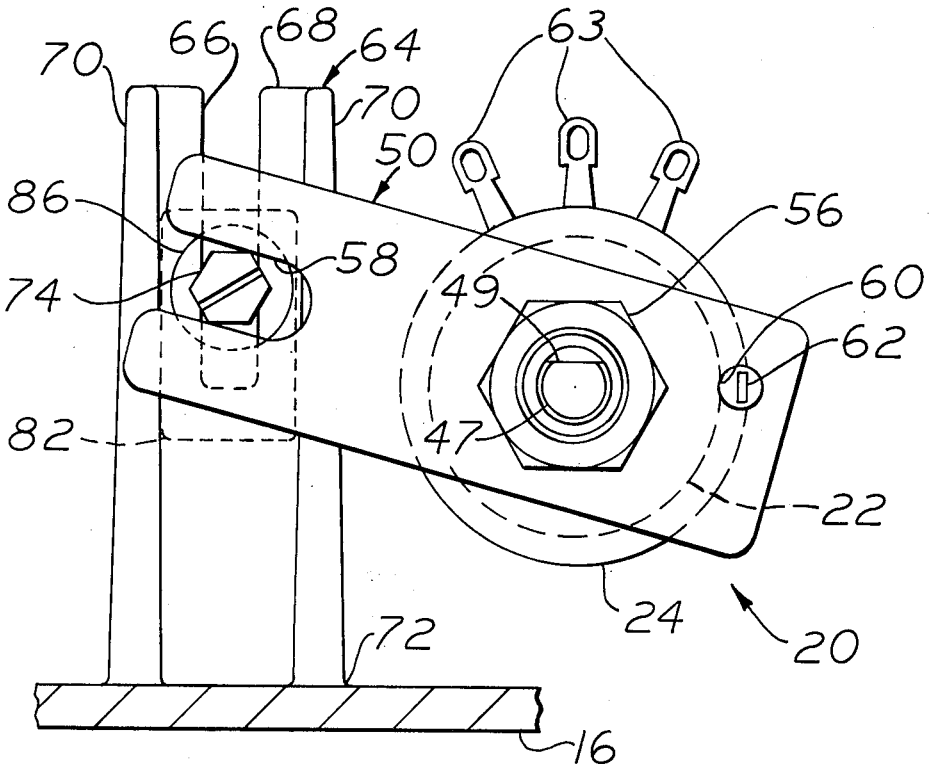
FIG. 3 is an exploded view taken along the line III—III of FIG. 2, further illustrating the apparatus of this invention.

In accordance with this invention, FIGS. 2 and 3 preferably illustrate an adjusting means such as a first member 50 connected to outer potentiometer portion 24. This is accomplished by inserting threaded sleeve 52 of outer portion 24 through a first aperture 54 formed in member 50. A nut 56 is then threaded onto sleeve 52 for securing member 50 in engagement with outer potentiometer portion 24. In addition to aperture 54, fabricated steel member 50 includes a slot 58 formed therein at one end and a second aperture 60 formed therein at another end.

A well known tab 62, of any suitable material, is connected to and extends from outer potentiometer portion 24 received through aperture 60 in engagement with member 50. In this manner, outer potentiometer portion 24 is properly oriented with member 50. Also, member 50 is connected for movably adjusting outer potentiometer portion 24 relative to inner portion 22.

As a secondary consideration, tab 62 in aperture 60 will limit slippage between member 50 and outer potentiometer portion 24. Also, well known leads 63 extend from potentiometer 20 for providing a means of making electrical connection with potentiometer 20.

Also, preferably, a support means such as a second member 64 is connected in the housing for supporting member 50 relative to potentiometer 20. This is accomplished by providing a pillar-like second member 64 as an elongated preferably injection molded plastic member having a transverse cross-section similar to an I-beam. A slot 66 is provided in one end of member 64 at rib 68 between parallel flanges 70. The other end or base 72 of member 64 is preferably injection molded with housing 16. Slot 66 of member 64 is in overlapping relationship with slot 58 of member 50.

A positioning means for adjustably interconnecting first and second slotted members 50, 64, respectively, such as bolt 74, is provided. Bolt 74 includes a head end 76 and a threaded shaft portion 78. Shaft portion 78 extends through slots 58 and 66. End 80 of shaft portion 78 is preferably secured by a torque resistant metal plate 82 threadedly received thereon. Plate 82 includes a threaded aperture 83 and is provided to abut rib 68 between flanges 70. In this manner, bolt 74 is rotatable relative to members 50, 64 and plate 82 is secured by member 64 from rotating relative members 50 and 64.

A sleeve or spacer 84 is carried by shaft portion 78 of bolt 74 between head end 76 and second member 64. Spacer 84 extends through slot 58 of member 50. Washer 86 is placed on one side of rib 68 abutting spacer 84. In this manner, slot 58 is slidably engaged with spacer 84, permitting member 50 to "float" relative to member 64 and avoid imposing side loads on shaft 47.

In operation, with the parts connected as hereinabove described, it may be desired to adjust the outer potentiometer portion 24 relative to the inner potentiometer portion 22.

Bolt 74 may be loosened relative to members 50, 64 thus permitting bolt 74 to be slidably moved within slots 58, 66. As a result, member 50 will rotate with sleeve 52 and outer potentiometer portion 24 relative to shaft 47 and inner potentiometer portion 22 which remain stationary during such adjustment. Tab 62 extending through aperture 60 of member 50 primarily aids in orienting and rotating outer member 24 relative to inner member 22 and, secondarily, limits relative movement between member 50 and outer portion 24 in the event of slippage between member 50 and sleeve 52.

The foregoing has described a means for efficiently adjusting a potentiometer in an accelerator control of an electrically powered vehicle.

The embodiments of the invention in which an exclusive property or privilege is claimed are defined as follows:

1. In apparatus having a power souce, a movable accelerator element operably connected to an accelerator control housing, a switch in the housing responsive to movement of the accelerator element and a potentiometer in the housing including an inner potentiometer portion movable relative to an outer potentiometer portion in response to movement of the accelerator element, the improvement comprising:

adjusting means connected for adjusting the outer potentiometer portion relative to the inner portion, the adjusting means including a slot formed in one end;

support means connected in the housing for supporting the adjusting means relative to the potentiometer, the support means including a slot formed in one end in overlapping relationship with the slot of the adjusting means; and positioning means interconnecting the adjusting and support means for positioning the adjusting means relative to the support means, the positioning means includes a bolt passing through the slots.

2. The apparatus of claim 1, further including:

a spacer on the bolt between a head end of the bolt and the support means, the spacer passing through the slot in the adjusting means.

3. The apparatus of claim 1, further comprising:

a tab extending from the outer potentiometer portion in engagement with the adjusting means.

4. The apparatus of claim 2, further comprising:

a member threadably received on the bolt and secured by the support means from rotating relative thereto.

5. In apparatus having a power source, a movable accelerator element operably connected to an accelerator control housing, a switch in the housing responsive to movement of the accelerator element and a potentiometer in the housing including an inner potentiometer portion movable relative to an outer potentiometer portion thereof in response to movement of the accelerator element, the improvement comprising:

a first slotted member connected to the outer potentiometer portion;

a second slotted member connected to the housing; and means for adjustably interconnecting the first and second slotted members.

6. The apparatus of claim 5, wherein:

the means for adjustably interconnecting the first and second slotted members includes a bolt rotatable relative to the first and second members and a threaded member secured from rotating relative to the first and second members.

7. The apparatus of claim 5, further comprising:

a tab extending from the outer potentiometer portion in engagement with the first member.

8. The apparatus of claim 5, wherein:

the means for adjustably interconnecting the first and second slotted members includes a bolt passing through the first slotted member, through the second slotted member, and simultaneously movable relative to the first and second slotted members.

9. The apparatus of claim 8, further comprising:

a spacer on the bolt between a head end of the bolt and the second slotted member; and a member threadably received on the bolt and secured by the second member from rotating relative thereto.

10. In apparatus having a movable accelerator element, a switch responsive to movement of the accelerator element and a potentiometer including an inner potentiometer portion movable relative to an outer potentiometer portion in response to movement of the accelerator element, the improvement comprising:

adjusting means connected for adjusting the outer potentiometer portion relative to the inner portion, the adjusting means including a slot formed in one end;

support means connected for supporting the adjusting means relative to the potentiometer, the support means including a slot formed in one end in overlapping relationship with the slot of the adjusting means; and means for positioning the adjusting means relative to the support means.

11. The apparatus of claim 10 wherein the positioning means includes a member passing through the adjusting means slot and the support means slot.

12. Apparatus comprising a potentiometer having first means connected for moving an inner potentiometer portion relative to an outer potentiometer portion, the improvement comprising:

second means connected for moving the outer portion relative to the inner portion, said second means comprising an adjusting arm having a first end adjustably connected to a support and a second end connected to the outer portion.

13. Apparatus comprising a first support and a potentiometer having first means connected to the first support for moving an inner potentiometer portion relative to an outer potentiometer portion, the improvement comprising:

a second support; and second means for moving the outer portion relative to the inner portion, said second means comprising an adjusting arm having a first end adjustably connected to the second support and a second end pivotally connected to the outer portion.

14. Apparatus comprising:

an accelerator control housing;

an accelerator element operably connected to the housing;

a switch in the housing responsive to movement of the accelerator element;

a potentiometer in the housing including an inner potentiometer portion movable relative to an outer potentiometer portion in response to movement of the accelerator element;

first means connected for moving the inner potentiometer portion relative to the outer potentiometer portion; and second means connected for moving the outer portion relative to the inner portion, said second means comprising an adjusting arm having a first end adjustably connected to a support and a second end connected to the outer portion.

15. An industrial vehicle comprising:

an accelerator control housing;

an accelerator element operably connected to the housing;

a potentiometer in the housing including an inner potentiometer portion movable relative to an outer potentiometer portion in response to movement of the accelerator element;

a first support;

first means connected to the first support for moving the inner portion relative to the outer portion;

a second support; and second means for moving the outer portion relative to the inner portion, said second means comprising an adjusting arm having a first end adjustably connected to the second support and a second end pivotally connected to the outer portion.

* * * * *